US008168550B2

(12) United States Patent
Collias et al.

(10) Patent No.: US 8,168,550 B2
(45) Date of Patent: May 1, 2012

(54) EXTENSIBLE NONWOVEN WEBS CONTAINING MONOCOMPONENT NANOCOMPOSITE FIBERS

(75) Inventors: Dimitris Ioannis Collias, Mason, OH (US); Norman Scott Broyles, Hamilton, OH (US); Eric Bryan Bond, Maineville, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 1066 days.

(21) Appl. No.: 11/606,820

(22) Filed: Nov. 30, 2006

(65) Prior Publication Data

US 2008/0132862 A1 Jun. 5, 2008

(51) Int. Cl.
*D04H 3/00* (2012.01)
*B32B 5/02* (2006.01)

(52) U.S. Cl. ..... 442/347; 442/328; 442/329; 442/334; 442/340; 442/351

(58) Field of Classification Search ..... 442/328, 442/329, 334, 340, 347, 351
See application file for complete search history.

(56) References Cited

U.S. PATENT DOCUMENTS

| | | | |
|---|---|---|---|
| 3,855,046 | A | 12/1974 | Hansen et al. |
| 4,021,284 | A | 5/1977 | Kalwaites |
| 4,024,612 | A | 5/1977 | Contractor et al. |
| 5,518,801 | A | 5/1996 | Chappell et al. |
| 5,650,214 | A | 7/1997 | Anderson et al. |
| 5,932,497 | A | 8/1999 | Morman et al. |
| 6,013,151 | A | 1/2000 | Wu et al. |
| 6,476,135 | B1 | 11/2002 | Bugada et al. |
| 6,544,644 | B1 | 4/2003 | Bouquerel et al. |
| 2002/0188041 | A1 | 12/2002 | Bond et al. |
| 2003/0028165 | A1 | 2/2003 | Curro et al. |
| 2004/0131820 | A1 | 7/2004 | Turner et al. |
| 2004/0166143 | A1 | 8/2004 | Last et al. |
| 2005/0124744 | A1 | 6/2005 | Demain |
| 2005/0181206 | A1 | 8/2005 | Endo et al. |
| 2006/0058441 | A1 | 3/2006 | Delker et al. |
| 2008/0044654 | A1 | 2/2008 | Cadoret et al. |

FOREIGN PATENT DOCUMENTS

| | | | | |
|---|---|---|---|---|
| WO | WO-2004/058214 | A1 | | 7/2004 |
| WO | WO-2004/059061 | A1 | | 7/2004 |
| WO | WO 2005118924 | A1 | * | 12/2005 |
| WO | WO-2007/048547 | A1 | | 5/2007 |

OTHER PUBLICATIONS

U.S. Appl. No. 11/606,821, filed Nov. 30, 2006, Dimitris I. Collias.
International Search Report mailed Mar. 27, 2008 (6 pages).

* cited by examiner

*Primary Examiner* — Matthew Matzek
(74) *Attorney, Agent, or Firm* — David K Mattheis; Kim W Zerby

(57) ABSTRACT

The present invention provides nonwoven webs comprising monocomponent nanocomposite fibers that enable the nonwoven webs to possess high extensibility. The monocomponent nanocomposite fibers comprise a polymer composition and a nanoparticles composition. The nonwoven webs comprising the monocomponent nanocomposite fibers have an average elongation at peak load which is greater than the average elongation at peak load of comparable nonwoven webs without nanocomposite fibers.

20 Claims, No Drawings

EXTENSIBLE NONWOVEN WEBS CONTAINING MONOCOMPONENT NANOCOMPOSITE FIBERS

FIELD OF THE INVENTION

The present invention relates to extensible nonwoven webs comprising monocomponent nanocomposite fibers and disposable articles comprising such nonwoven webs.

BACKGROUND OF THE INVENTION

Nonwoven webs formed by nonwoven extrusion processes such as, for example, meltblowing and spunbonding processes may be manufactured into products and components of products so inexpensively that the products could be viewed as disposable after only one or a few uses. Exemplary products include disposable absorbent articles, such as diapers, incontinence briefs, training pants, feminine hygiene garments, wipes, and the like.

There is an existing consumer need for nonwovens that can deliver softness and extensibility when used in disposable products. Softer nonwovens are gentler to the skin and help provide a more garment-like aesthetic for diapers. Nonwovens that are capable of high extensibility can be used to provide sustained fit in products such as disposable diapers, for example, as part of a stretch composite, and facilitate the use of various mechanical post-treatments such as stretching, aperturing, etc. Extensible materials or structures are defined herein as those capable of elongating, but not necessarily recovering all or any of the applied strain. Elastic materials, on the other hand, by definition, must recover a substantial portion of their elongation after the load is removed.

There exists within the industry today a need for extensible nonwovens with moderate to low denier fibers that can be made from resins without the need for high cost specialty polymers or elastic polymers. It is well known to those trained in the art that as spinning attenuation velocities increase, molecular orientation increases and fiber elongation decreases. For strong, low denier fibers with low elongation, this is not a problem, but producing low denier fibers with high elongation remains a significant challenge. It is therefore an object of the present invention to provide nonwoven webs comprising low denier fibers that can be made from conventional resins without the need for costly additives. It is a further object of the present invention to provide disposable articles comprising such soft extensible nonwoven webs.

SUMMARY OF THE INVENTION

Extensible nonwoven webs comprising monocomponent nanocomposite fibers are disclosed. The monocomponent nanocomposite fibers comprise a polymer composition and a nanoparticles composition. The weight of the nanoparticles composition relative to the weight of the monocomponent nanocomposite fiber is between about 0.1% and about 70%. The nonwoven webs of the present invention may further comprise non-nanocomposite monocomponent or multicomponent fibers.

In one embodiment, the average elongation at peak load of the nonwoven web of the present invention may exceed about 80% in at least one direction. In another embodiment, the nonwoven webs of the present invention may have an average elongation at peak load which is greater than the average elongation at peak load of comparable nonwoven webs without the monocomponent nanocomposite fibers. In still another embodiment, the cross-direction (also called transverse direction; CD) elongation index of the nonwoven web of the present invention is at least about 1.5 relative to a comparable nonwoven web without the monocomponent nanocomposite fibers.

The nonwoven web of the present invention may have a basis weight of from about 5 to about 100 grams per square meter (g/m$^2$; gsm) and may be produced by a spunbonding process. The diameter of the fibers comprising the nonwoven web will typically be from about 5 to about 50 μm.

The polymer composition of any monocomponent nanocomposite fiber may contain a single polymer. The single polymer may be polypropylene. Alternatively, the polymer composition of any monocomponent nanocomposite fiber may comprise a blend of two or more polymers. These polymers might be polypropylenes or polypropylene and one or more different polymers. In one embodiment, the melt flow rate of the polymer composition is from about 10 to about 1000 grams per 10 minutes (g/10 min).

The present invention is also directed to the fibers used in the nonwoven webs. The nonwoven webs of the present invention may be used to make disposable articles.

DETAILED DESCRIPTION OF THE INVENTION

As used herein, the term "monocomponent fiber" refers to a fiber having only one component, i.e., one solid part across its cross-section. A hollow fiber can also be called "monocomponent fiber" as long as it has only one solid part in its cross-section, besides air in the middle.

As used herein, the term "absorbent article" refers to devices that absorb and contain body exudates, and, more specifically, refers to devices that are placed against or in proximity to the body of the wearer to absorb and contain the various exudates discharged from the body.

As used herein, the term "disposable" is used to describe absorbent articles that are not intended to be laundered or otherwise restored or reused as absorbent articles (i.e., they are intended to be discarded after a single use and, to be recycled, composted or otherwise disposed of in an environmentally compatible manner). A "unitary" absorbent article refers to an absorbent article that is formed of separate parts united together to form a coordinated entity so that it does not require separate manipulative parts like a separate holder and liner.

As used herein, the term "nonwoven web", refers to a web that has a structure of individual fibers or threads which are interlaid, but not in any regular, repeating manner. Nonwoven webs have been, in the past, formed by a variety of processes, such as, for example, air laying processes, meltblowing processes, spunbonding processes and carding processes, including bonded carded web processes.

As used herein, the term "microfibers" refers to small diameter fibers having an average diameter not greater than about 100 μm, and a length-to-diameter ratio of greater than about 10. Those trained in the art will appreciate that the diameter of the fibers comprising a nonwoven web impact its overall softness and comfort, and that the smaller denier fibers generally result in softer and more comfortable products than larger denier fibers. For fibers of the present invention, it is preferable that the diameters are in the range of about 5 to 50 μm to achieve suitable softness and comfort, more preferable in the range from about 5 to 35 μm, and even more preferable in the range from about 15 to 30 μm. The fiber diameter can be determined using, for example, an optical microscope calibrated with a 10 μm graticule.

As used herein, the term "meltblown fibers", refers to fibers formed by extruding a molten thermoplastic material through a plurality of fine, usually circular, die capillaries as molten threads or filaments into a high velocity gas (e.g., air) stream which attenuates the filaments of molten thermoplastic material to reduce their diameter to generally from 0.5 to 10 μm, but more typically in the range from 1 to 5 μm. Thereafter, the meltblown fibers are carried by the high velocity gas stream and are deposited on a collecting surface to form a web of randomly dispersed meltblown fibers.

As used herein, the term "spunlaid fibers" refers to small diameter fibers that are formed by extruding a molten thermoplastic material as filaments from a plurality of fine, usually circular, capillaries of a spinneret with the diameter of the extruded filaments then being rapidly reduced by drawing. A spunlaid nonwoven web may be produced, for example, by the conventional spunlaid process wherein molten polymer is extruded into continuous filaments which are subsequently quenched, attenuated by a high velocity fluid, and collected in random arrangement on a collecting surface. After filament collection, any thermal, chemical or mechanical bonding treatment, or any combination thereof (i.e., "spunbonding" process), may be used to form a bonded web such that a coherent web structure results. Thermal point bonding of a spunlaid nonwoven web produces a "spunbonded" nonwoven web.

In one embodiment, nonwoven webs in the present invention may contain only spunlaid fibers. In another embodiment, the nonwoven webs may contain a mixture of spunlaid fibers and meltblown fibers either in discrete layers or mixtures. In another embodiment, the nonwoven webs may contain multiple layers of spunlaid fibers and meltblown fibers that differ in concentrations of nanoparticles. These unbonded fibers are the consolidated together.

As used herein, the term "staple fibers" refers to small diameter fibers that are formed by extruding a molten thermoplastic material as filaments from a plurality of fine, usually circular, capillaries of a spinneret with the diameter of the extruded filaments then being rapidly reduced by drawing, typically using conventional godet winding systems. The fiber diameter can be further reduced through post-extrusion drawing prior to cutting the fibers into discontinuous lengths. The fibers may also have finish applied or be crimped to aid in, for example, a carding process. Staple fibers may be used, for example, to make nonwoven fabrics using carding, airlaid or wet-laid processes.

As used herein, the term "nanocomposite fiber" refers to a fiber comprising nanoparticles.

Monocomponent continuous, staple, hollow, shaped (such as multi-lobal) fibers can all be produced by using the methods of the present invention. The fibers of the present invention may have different geometries that include round, elliptical, star shaped, rectangular, and other various eccentricities. As used herein, the diameter of a noncircular cross section fiber is the equivalent diameter of a circle having the same cross-sectional area.

As used herein, the term "extensible nonwoven" refers to any nonwoven, which upon application of an extending force, has an average CD elongation at peak load of at least about 80%, in one embodiment, at least about 100%, and in another embodiment, at least about 140%. The average elongation at peak load described herein is determined according to the method outlined in the tensile testing methods section for nonwoven webs.

As used herein, the term "elongation index" refers to the average elongation at peak load for a nonwoven web containing nanocomposite fibers divided by the average elongation at peak load for a comparable nonwoven web without nanocomposite fibers. "Comparable" refers to nonwoven webs which are produced with about the same throughput, have about the same basis weight, and their fibers have about the same diameter and comprise the same polymer composition but lack the nanoparticles composition. In one embodiment, the elongation index is greater than 1, in another embodiment, it is greater than 1.2, and in yet another embodiment, it is greater than 1.5. In some cases, the elongation index is greater than 2.

As used herein, the terms "consolidation" and "consolidated" refer to the bringing together of at least a portion of the fibers of a nonwoven web into closer proximity to form a site, or sites, which function to increase the resistance of the nonwoven to external forces, e.g., abrasion and tensile forces, as compared to the unconsolidated web. "Consolidated" can refer to an entire nonwoven web that has been processed such that at least a portion of the fibers are brought into closer proximity, such as by thermal point bonding. Such a web can be considered a "consolidated web". In another sense, a specific, discrete region of fibers that is brought into close proximity, such as an individual thermal bond site, can be described as "consolidated". Consolidation can be achieved by methods that apply heat and/or pressure to the fibrous web, such as thermal spot (i.e., point) bonding. Thermal point bonding can be accomplished by passing the fibrous web through a pressure nip formed by two rolls, one of which is heated and contains a plurality of raised points on its surface, as is described in U.S. Pat. No. 3,855,046 issued to Hansen et al. Consolidation methods can also include, but are not limited to, ultrasonic bonding, through-air bonding, resin bonding, and hydroentanglement. Hydroentanglement typically involves treatment of the fibrous web with high pressure water jets to consolidate the web via mechanical fiber entanglement (friction) in the region desired to be consolidated, with the sites being formed in the area of fiber entanglement. The fibers can be hydroentangled as taught in U.S. Pat. No. 4,021,284 issued to Kalwaites and U.S. Pat. No. 4,024,612 issued to Contrator et al.

Polymer Composition

The polymer composition of the monocomponent nanocomposite fibers may contain one or more polymers. Examples of suitable polymers for use in the present invention include, but are not limited to, polyethylene (including ultra low density ($\rho<0.9$ g/mL) up to high density polyethylene ($\rho>0.953$ g/mL)), ethylene-propylene elastomer, polypropylene, copolymers of ethylene and propylene, polyamides, polyesters, aliphatic ester polycondensates, poly (caprolactone), poly(ethylene succinate), poly(ethylene succinate adipate), poly(butylene succinate), poly(butylene succinate adipate), aliphatic polyester-based polyurethanes, copolyesters of adipic acid, terephthalic acid, and 1,4-butanediol, polyester-amides, biodegradable polymers (such as polyhydroxyalkonoate (PHA), polylactic acid (PLA), starch, thermoplastic starch, and other biodegradable polymers described in U.S. Publication 2002/0188041A1), other polymers (as described in U.S. Pat. No. 6,476,135), and copolymers or blends thereof.

Also, the polymer composition may generally include, but is not limited to, homopolymers, copolymers, such as, for example, block, graft, random and alternating copolymers, terpolymers, etc., and blends and modifications thereof. The polymer composition may include all possible stereochemical configurations of the polymeric chemical structure. These configurations include, but are not limited to, isotactic, syndiotactic, atactic, and random.

The polymer composition may be a blend of polymers. In one embodiment, the polymer composition is a blend of polypropylene resins with various isotactic, atactic and syndiotactic configurations. The polymer blend may be intentional blend of separate polymers or a consequence of the polymerization technology used to produce the polymer.

The polymer composition of the present invention may optionally include additional ingredients. Suitable additional ingredients include, but are not limited to, those which are typically used in fiber making, nonwoven processing, and polymer formation. In the case of the polymer blend, desirable additional ingredients are those which form a solid solution and/or homogeneous mixture with the polymer blend and other constituents of the polymer composition. In one aspect, the additional ingredients are selected from the group that includes nucleating agents, pigments or coloring agents (e.g. titanium dioxide), antiblock agents, antistatic agents, proheat stabilizers, softening agents, lubricants, surfactants, wetting agents, plasticizers, light stabilizers, weathering stabilizers, weld strength improvers, slip agents, dyes, antioxidants, flame retardants, pro-oxidant additives, natural oils, synthetic oils, anti-blocking agents, fillers, coefficient of friction modifiers, humectants, and combinations thereof. Additionally, any coatings or surface treatments for the fibers may be added during processing or after the fibers are formed. In the polymer composition, the additional ingredient will comprise an amount effective to achieve the result the additional ingredient is present in the polymer composition to achieve. For example, a stabilizing amount for a UV stabilizer, a lubricating amount for a lubricating agent. For a skin conditioning agent, an amount of an agent that has an effect on the skin would be desired. Typically, the additional ingredient is from about 0.1% to about 5% of the polymer composition. These additional ingredients may be employed in conventional amounts although, typically, such ingredients are not required in the composition in order to obtain the advantageous combination of softness and extensibility.

In one embodiment, the monocomponent nanocomposite fibers comprise a thermoplastic polymer. The thermoplastic polymer may contain polypropylene, which may be a high melt flow rate polypropylene. The polypropylene may also comprise a low melt flow rate polypropylene. In one embodiment, the high melt flow rate polypropylene will have a melt flow rate in the range from about 10 to about 1000 g/10 min. In another embodiment, the high melt flow rate polypropylene will have a melt flow rate in the range from about 10 to about 800 g/10 min. In yet another embodiment, the high melt flow rate polypropylene will have a melt flow rate in the range from about 10 to about 600 g/10 min. In one embodiment, the low melt flow rate polypropylene will have a melt flow rate of from about 10 to about 80 g/10 min. In another embodiment, the low melt flow rate polypropylene will have a melt flow rate of from about 15 to about 70 g/10 min. In one embodiment, the melt flow rate of the polypropylene blend will be from about 10 to about 1000 g/10 min. In another embodiment, the melt flow rate of the polypropylene blend will be from about 10 to about 600 g/10 min. The melt flow rate as described herein is determined according to the method outlined in ASTM D 1238 (condition L; 230/2.16), incorporated herein by reference. Those trained in the art will recognize that the polymer compositions with the above described ranges of melt flow rates are typically used in a spunlaid process.

Nanoparticles Composition

The nanoparticles composition comprises nanoparticles, and, optionally, treatment compounds, compatibilizers, and carrier polymers.

Nanoparticles are discrete particles comprising at least one dimension in the nanometer range. In use, the nanoparticles may be agglomerated and may not exist as discrete nanoparticles. Nanoparticles can be of various shapes, such as spherical, fibrous, polyhedral, platelet, regular, irregular, etc.

The nanoparticles may comprise clay nanoparticles (also called nanoclay particles, interchangeably). These particles consist of platelets that may have a fundamental thickness of about 1 nm and a length or width of between about 100 nm and about 500 nm. In their natural state, these platelets are about 1 to about 2 nm apart. In an intercalated state, the platelets may be between about 2 and about 8 nm apart. In an exfoliated state, the platelets may be in excess of about 8 nm apart. In the exfoliated state the specific surface area of the nanoclay material can be about 800 $m^2/g$ or higher.

Non-limiting examples of nanoparticles are natural nanoclays (such as kaolin, talc, bentonite, hectorite, nontmorillonite, vermiculite, and mica), synthetic nanoclays (such as Laponite® from Southern Clay Products, Inc. of Gonzales, Tex.; and SOMASIF from CO-OP Chemical Company of Japan), nanofibers, metal nanoparticles (e.g. nano aluminum), metal oxide nanoparticles (e.g. nano alumina), metal salt nanoparticles (e.g. nano calcium carbonate), carbon or inorganic nanostructures (e.g. single wall or multi wall carbon nanotubes, carbon nanorods, carbon nanoribbons, carbon nanorings, carbon or metal or metal oxide nanofibers, etc.), and graphite platelets (e.g. expanded graphite, etc.). Exemplary nanoclay particles include montmorillonite clay nanoparticles.

Nanoparticles can comprise a treatment compound to modify their surfaces and make them more compatible with the polymer composition, and cause intercalation when the nanoparticles are nanoclay particles. Examples of treatment compounds for nanoparticles include, but are not limited to, calcium stearate, and other stearate compounds. Examples of treatment compounds for nanoclay particles include, but are not limited to, dimethyl benzyl hydrogenated tallow quaternary ammonium chloride, dimethyl dihydrogenated tallow quaternary ammonium chloride, dimethyl hydrogenated tallow 2-ethylhexyl quaternary ammonium chloride, methyl tallow bis-2-hydroxyethyl quaternary ammonium chloride, methyl dihydrogenated tallow quaternary ammonium chloride, or mixtures thereof. Nanoparticles that comprise treatment compound are called treated nanoparticles. More specifically, nanoclay particles that comprise treatment compound are called, interchangeably, treated nanoclay particles, or treated clay nanoparticles, or organoclay nanoparticles. Also, montmorillonite nanoparticles that comprise treatment compound are called, interchangeably, montmorillonite organoclay nanoparticles, or treated montmorillonite clay nanoparticles, or treated montmorillonite nanonoclay particles. Montmorillonite organoclay nanoparticles are available from Southern Clay Products, Inc. of Gonzales, Tex. (e.g. Cloisite® series of nanoclays); Elementis Specialties, Inc. of Hightstown, N.J. (e.g. Bentone® series of nanoclays); Nanocor, Inc. of Arlington Heights, Ill. (e.g. Nanomer® series of nanoclays); and Süd-Chemie, Inc. of Louisville, Ky. (e.g. Nanofil® series of nanoclays).

In one embodiment, the weight of treatment compound relative to the weight of treated nanoparticles is between about 20% and about 80%. In another embodiment, the weight of treatment compound relative to the weight of treated nanoparticles is between about 30% and about 60%. In yet another embodiment, the weight of treatment compound relative to the weight of treated nanoparticles is about 40%.

Nanoparticles or treated nanoparticles can comprise carrier resin to aid in dispersing them into the polymer composition. Non limiting examples or carrier resins are linear low density polyethylene, low density polyethylene, high density polyethylene, and polypropylene. In one embodiment, the weight of carrier resin relative to the monocomponent nanocomposite fiber is less than about 45%, in another embodiment, it is less than about 30%, and in yet another embodiment, it is less than about 10%.

Nanoparticles or treated nanoparticles can also comprise compatibilizer to aid in dispersion and improve the interfacial properties between the nanoparticles or treated nanoparticles and polymer composition. Non limiting examples of compatibilizers are copolymer of olefin with maleic anhydride, more specifically, copolymer of ethylene with maleic anhydride, or copolymer of propylene with maleic anhydride. In one embodiment, the weight of the copolymer of olefin with maleic anhydride relative to the monocomponent nanocomposite fiber is less than about 45%, in another embodiment, it is less than about 30%, and in yet another embodiment, it is less than about 10%. In one embodiment, the weight of the copolymer of olefin with maleic anhydride relative to the monocomponent nanocomposite fiber is more than about 1%, in another embodiment, it is more than about 2%, and in yet another embodiment, it is more than about 4%.

Examples of nanoparticles compositions which comprise treated montmorillonite nanoclay particles and compatibilizer, also called masterbatches, include, but are not limited to, NanoBlend™ 1201 and NanoBlend™ 1001 (PolyOne Corp., Avon Lake, Ohio), both of which comprise between about 38% and 42% treated montmorillonite nanoclay particles.

For the purposes of this invention, the weight of nanoparticles in the monocomponent nanocomposite fibers is specified on a treatment-compound-free basis, i.e., the nanoparticles without the treatment compounds. For inorganic nanoparticles, the weight of nanoparticles can be considered to be the residual amount after burning the nanoparticles or fibers in a furnace at 900° C. for 45 min. In one embodiment, the weight of nanoparticles in the monocomponent nanocomposite fibers is between about 0.1% and about 30%. In another embodiment, the lower limit on the weight of the nanoparticles may be about 1%. In still another embodiment, the lower limit may be about 2%. In yet another embodiment, the lower limit may be about 3%. In still yet another embodiment, the lower limit may be about 4%. In another embodiment, the upper limit may be about 25%. In yet another embodiment, the upper limit may be about 20%. In still another embodiment, the upper limit may be about 10%. The amount of the nanoparticles present in the nanocomposite fibers may be varied depending on the target product cost and the desired properties of the fibers.

The polymer and nanoparticles compositions may be mixed together in the melt so that the origination of composition and nanoparticles is not determinable. This mixing can be done either in a discrete step, commonly referred to as "precompounding", or done in situ with the process in which the monocomponent nanocomposite fibers are created. In one embodiment, the polymer composition is mixed with the nanoparticles composition in a precompounding step or in situ with the process in which the fibers are created. In another embodiment, the polymer composition is mixed with nanoparticles composition comprising treated montmorillonite clay nanoparticles in a precompounding step or in situ with the process in which the fibers are created. In yet another embodiment, the polymer composition is mixed with the nanoparticles composition comprising treated montmorillonite clay nanoparticles and copolymer of propylene and maleic anhydride in a precompounding step or in situ with the process in which the fibers are created.

In one embodiment, the nanoparticles comprise nanoclay particles that have been exfoliated by the addition of ethylene vinyl alcohol (EVOH). As a non-limiting example, a nanoclay montmorillonite material may be blended with EVOH (27 mole percent ethylene grade). The combination may then be blended with a polypropylene polymer and the resulting combination may be formed into monocomponent nanocomposite fibers.

In one embodiment, the nonwoven web comprises monocomponent fibers, the monocomponent fibers comprise nanocomposite fibers, and the nanocomposite fibers comprise polypropylene, copolymer of olefin and maleic anhydride, and treated montmorillonite clay nanoparticles, wherein the polypropylene has a melt flow rate of about 35 g/10 min, the weight of the copolymer of olefin and maleic anhydride in the monocomponent nanocomposite fibers is about 6%, the weight of the treated montmorillonite clay nanoparticles in the monocomponent nanocomposite fibers is about 2.4%, and the nonwoven web has a CD elongation index of at least about 1.5 relative to a comparable nonwoven web without nanocomposite fibers.

Nonwoven Webs

Typically, the fibers of the present invention are low denier which helps produce extremely soft, extensible and highly uniform nonwoven webs. Nonwoven webs with this combination of properties are particularly well suited for use in disposable absorbent articles such as diapers, incontinence briefs, adult incontinence, light incontinence products, training pants, feminine hygiene garments, wipes, and the like, as they are able to be used in portions of the article where extensibility and softness can aid in the articles' comfort and overall performance. Suitable applications for the nonwoven webs of the present invention include topsheet for feminine hygiene pads, diapers, and/or adult incontinence products, stretchable components for diapers such as ears or tabs, and cleansing wipes for hard surfaces such as floors or counters or for the skin such as facial cleansing, body cleansing, or baby wipes.

Although the nonwoven web of the present invention can find beneficial use as a component of a disposable absorbent article, such as a diaper, its use is not limited to disposable absorbent articles. The nonwoven web of the present invention can be used in any application requiring or benefiting from softness and extensibility, such as wipes, polishing cloths, floor cleaning wipes, furniture linings, durable garments, and the like. Many different wipes, such as facial cleansing cloths, body and personal cleansing cloths and/or hand mitts, and other beauty or personal cleansing applications may be desired.

If additional extensibility or activation of the nonowoven web is desired, a post processing treatment may be desired. Both mechanical and chemical post processing treatments may be suitable. Possible mechanical post processing treatments include stretching, tentoring, and other treatments found in U.S. Pat. Pub. 2004/0131820 and 2003/028165, WO 04/059061, WO 04/058214, and U.S. Pat. Nos. 5,518,801 and 5,650,214. Nonwovens that are capable of high extensibility, such as the nonwovens of the present invention, facilitate the use of mechanical post-treatments.

The extensible, soft nonwoven of the present invention may also be in the form of a laminate. Laminates may be combined by any number of bonding methods known to those skilled in the art including, but not limited to, thermal bonding, adhesive bonding including, but not limited to spray adhesives, hot melt adhesives, latex based adhesives and the like, sonic and ultrasonic bonding, and extrusion laminating whereby a polymer is cast directly onto another nonwoven, and while still in a partially molten state, bonds to one side of the nonwoven, or by depositing melt blown fiber nonwoven directly onto a nonwoven. These and other suitable methods for making laminates are described in U.S. Pat. No. 6,013,151, Wu et al., and U.S. Pat. No. 5,932,497, Morman et al. One use of the nonwoven web is a spunbonded layer in a spunbonded-meltblown-spunbonded (SMS) laminate. Alternatively, the nonwoven web could also be used as a meltblown layer.

Experimental Procedures

Fiber Analysis

Mounting of Fiber Samples: For each sample tested, 10-12 fibers were prepared. Fibers are randomly selected and separated from the bundle. The fiber is then taped to a rectangular paper frame, being sure to wrap tape and the end of the fiber over the backside the frame. Care is taken not to stretch or deform the fiber in any way.

Diameter Measurements: Mounted fibers are viewed on a Zeiss Axioskope microscope equipped with a color video camera and a display monitor. With the fiber in focus under a 40× objective lens and a lx eyepiece the diameter of the fiber is measured on the monitor in inches with a pair of calipers. The microscope is calibrated for this magnification, using a 1 mm scale divided into 100ths, manufactured by Graticules LTD.

Tensile Testing: Mounted samples are tensile tested on an MTS Synergie 400 material tester equipped with a calibrated 10 N load cell and Testworks 4 software version 4.04. Fibers are tested according to ASTM D3822, with a test gauge length of 1 in. and a crosshead speed of 2 in./min. Mounted fibers are loaded into tester grips. The paper frame is cut away on both sides of the fiber so paper does not interfere with test. An average of ten fibers is tested, and the average elongation at break is used as the measure of extensibility.

Spunbonded Nonwoven Web Production and Tensile Testing

Web Production: Polyolefin compositions are converted into spunbonded nonwoven webs on a pilot scale spunbonded nonwoven line equipped with a slot jet attenuation system, a perforated moving belt under vacuum and a thermal calendar bonding system. Webs are produced using a mass throughput of 0.4 grams per hole per minute (ghm), and the line speed is adjusted to achieve a basis weight of approximately 20 gsm, unless specified otherwise. The bonding temperature is optimized for each sample, but was generally found to be about the same as the Comparative Example. The bonding temperature is the actual surface temperature of the calender with one calender roll being "engraved" with a bond area of 18% and the other calender being a smooth roll. The bonding pressure is kept constant at 350 pounds per linear inch, unless otherwise specified. The bonding temperature is optimized to be the best combination of CD tensile strength and elongation at peak load. In any case, the conditions chosen were for CD tensile strengths no less than 10% below the CD maximum.

Tensile Testing: For each nonwoven web, one tensile test strip is prepared by first cutting a 1 in. width strip in the direction of interest using a JDC Precision Sample Cutter (Thwing-Albert Instrument Company, Philadelphia, Pa. The length of the sample strip is then trimmed to about 7 in. Each sample strip is tensile tested on a testing machine, for example, on an Instron 1122 modified with a MTS Sintech ReNew Upgrade Package and equipped with a 50 lb load cell, 1 in. width serrated grip faces, and Testworks Software Version 3.1, or on a MTS Synergie 400 test stand equipped with a 100 N load cell, 1 in. width rubber grip faces, and Testworks Software Version 4.07 (Instron Corporation, Canton, Mass.; MTS Systems Corporation, Eden Praire, Minn.). Sample strips are tested with a gauge length of 5 in. and a crosshead speed of 5 in./min. An average of ten nonwoven strips is tested, and the average elongation at peak load is used as the measure of extensibility.

Comparative Example 1

Polypropylene ProFax PH835 (Basell Polyolefins Corp., Wilmington, Del.) with melt flow rate of 35 g/10 min is spun and bonded into nonwoven web using a line speed of 90 n/min and a calender bonding temperature of 125° C. on the engraved and smooth roll surfaces. The spinning is done using a 288-hole capillary count pack with sheath/core bicomponent capability. ProFax PH835 is used in both sheath and core, thus producing monocomponent fibers. The fibers are drawn to 1.8 dpf (denier per filament; i.e., 16.8 μm diameter), and produced at 0.4 ghm flow rate. The nonwoven web has a basis weight of 20 gsm. The average fiber tensile strength is 230 MPa and elongation at break is 284%. The nonwoven web is tested for its tensile properties. The average MD tensile strength is 4.6 N/cm and elongation at peak load is 40%. The average CD tensile strength is 2.9 N/cm and elongation at peak load is 68%.

Example 1

A blend of 90% by weight polypropylene ProFax PH835 and 10% by weight NanoBlend™ 1201 is prepared. The fibers are spun and bonded into nonwoven web using the same equipment and conditions as in Comparative Example 1. This blend is used in both sheath and core, thus producing monocomponent fibers. The average fiber tensile strength is 189 MPa and elongation at break is 289%. The nonwoven web is tested for its tensile properties. The average MD tensile strength is 8.7 N/cm and elongation at peak load is 87%, which is about 118% greater than that of the comparable nonwoven web without nanocomposite fibers of Comparative Example 1. Thus, the MD elongation index is about 2.2. The average CD tensile strength is 3.1 N/cm and elongation at peak load is 156%, which is about 130% greater than that of the comparable nonwoven web without nanocomposite fibers of Comparative Example 1. Thus, the CD elongation index is about 2.3.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A nonwoven web comprising monocomponent nanocomposite fibers, the nanocomposite fibers comprising:

a) a polymer composition; and b) a nanoparticles composition, wherein the nonwoven web has an average elongation at peak load that is greater than the average elongation at peak load of a comparable web without nanocomposite fibers.

2. The nonwoven web according to claim 1 wherein the weight of the nanoparticles composition relative to the weight of the monocomponent nanocomposite fiber is from about 0.1% to about 70%.

3. The nonwoven web according to claim 1 wherein the polymer composition comprises a polypropylene composition.

4. The nonwoven web according to claim 1 wherein the polymer composition comprises a polypropylene composition comprising at least two different polypropylenes.

5. The nonwoven web according to claim 1 wherein the monocomponent nanocomposite fibers have a diameter of from about 5 to about 50 μm.

6. The nonwoven web according to claim 1 further comprising non-nanocomposite fibers.

7. The nonwoven web according to claim 1 wherein the nonwoven web is produced by a spunbonding process.

8. The nonwoven web according to claim 1 wherein the nanoparticles comprise treated montmorillonite clay nanoparticles.

9. The nonwoven web according to claim 1 wherein the nanoparticles composition comprises a copolymer of olefin and maleic anhydride.

10. A disposable article comprising the nonwoven web according to claim 1.

11. The nonwoven web according to claim 1 wherein the web is an article selected from the group consisting of a topsheet for feminine hygiene pad, diaper, and/or adult incontinence product, stretchable ears for diapers, cleansing wipes for a hard surface or the skin, and combinations thereof.

12. A nonwoven web comprising monocomponent fibers nanocomposite fibers, the nanocomposite fibers comprising:

a) a polymer composition, and b) a nanoparticles composition, wherein the nonwoven web has a CD elongation index of at least about 1.5 relative to a comparable nonwoven web without nanocomposite fibers.

13. The nonwoven web according to claim 12 wherein the weight of the nanoparticles composition relative to the weight of the monocomponent nanocomposite fiber is from about 0.1% to about 70%.

14. The nonwoven web according to claim 12 wherein the polymer composition comprises a polypropylene composition.

15. The nonwoven web according to claim 12 wherein the monocomponent fibers have a diameter of from about 5 to about 50 μm.

16. The nonwoven web according to claim 12 wherein the nonwoven web is produced by a spunbonding process.

17. A disposable article comprising the nonwoven web according to claim 12.

18. The nonwoven web according to claim 12 wherein the nanoparticles composition comprises treated montmorillonite clay nanoparticles.

19. The nonwoven web according to claim 12 wherein the nanoparticles composition comprises a copolymer of olefin and maleic anhydride.

20. A nonwoven web comprising monocomponent nanocomposite fibers, the nanocomposite fibers comprising:

a) polypropylene, b) copolymer of olefin and maleic anhydride, and c) treated montmorillonite clay nanoparticles, wherein the polypropylene has a melt flow rate of about 35 g/10 min, the weight of the of the copolymer of olefin and maleic anhydride in the monocomponent nanocomposite fibers is about 6%, the weight of the treated montmorillonite clay nanoparticles is about 2.4%, and the nonwoven web has a CD elongation index of at least about 1.5 relative to a comparable nonwoven web without nanocomposite fibers.

* * * * *